US008011219B2

(12) United States Patent
Hagen et al.

(10) Patent No.: US 8,011,219 B2
(45) Date of Patent: Sep. 6, 2011

(54) METHOD OF CONTROLLING MANDREL IN A TUBE-EXTRUDING PRESS

(75) Inventors: Ewald Hagen, Langenfeld (DE); Arnold Schwippe, Leverkusen (DE); Andreas Wershofen, Grevenbroich (DE)

(73) Assignee: SMS Eumuco GmbH, Leverkusen (DE)

( * ) Notice: Subject to any disclaimer, the term of this patent is extended or adjusted under 35 U.S.C. 154(b) by 744 days.

(21) Appl. No.: 10/586,202

(22) PCT Filed: Jan. 14, 2005

(86) PCT No.: PCT/DE2005/000049

§ 371 (c)(1),
(2), (4) Date: Jun. 25, 2008

(87) PCT Pub. No.: WO2005/068100

PCT Pub. Date: Jul. 28, 2005

(65) Prior Publication Data

US 2008/0245125 A1 Oct. 9, 2008

(30) Foreign Application Priority Data

Jan. 15, 2004 (DE) ..... 10 2004 002 377
Jan. 13, 2005 (DE) ..... 10 2005 001 764

(51) Int. Cl.
*B21C 23/04* (2006.01)

(52) U.S. Cl. ..... 72/264; 72/19.9; 72/253.1; 72/453.06

(58) Field of Classification Search ..... 72/19.9, 72/20.2, 31.13, 253.1, 264, 265, 266, 271, 72/273, 453.02, 453.06
See application file for complete search history.

(56) References Cited

U.S. PATENT DOCUMENTS

| | | | | |
|---|---|---|---|---|
| 3,180,124 | A * | 4/1965 | Robra | 72/20.2 |
| 3,350,911 | A * | 11/1967 | Horst | 72/265 |
| 3,362,208 | A | 1/1968 | Murphy et al. | |
| 3,709,013 | A | 1/1973 | Petsch | |
| 3,868,841 | A * | 3/1975 | Couchman | 72/260 |
| 3,950,979 | A * | 4/1976 | Fuchs, Jr. | 72/265 |
| 4,230,661 | A * | 10/1980 | Asari et al. | 264/323 |
| 4,397,175 | A * | 8/1983 | Shear | 72/453.02 |
| 4,523,444 | A * | 6/1985 | Fuchs, Jr. | 72/21.1 |

FOREIGN PATENT DOCUMENTS

GB 929 056 6/1963

* cited by examiner

*Primary Examiner* — Edward Tolan
(74) *Attorney, Agent, or Firm* — Andrew Wilford

(57) ABSTRACT

The invention relates to a method for adjusting the position of a mandrel (10), which is situated in a hydraulic punch consisting of a cylinder and a ram that form a mandrel cylinder (8), in an extrusion press for producing pipes (2), which are extruded from blocks (4) that are loaded into a receiving device (5) situated upstream of the extrusion press (3) and are punched using the mandrel (10). The invention is characterised in that the mandrel cylinder (8) is driven directly by pumps (11), which are set for a pre-calculated throughput that is dependent on the press speed, and that an additional throughput is added to the pre-calculated pump throughput. To adjust the position of the mandrel (10), a control valve (16) that acts on the ring side (12) of the mandrel (8) is connected to a tank (17).

6 Claims, 1 Drawing Sheet

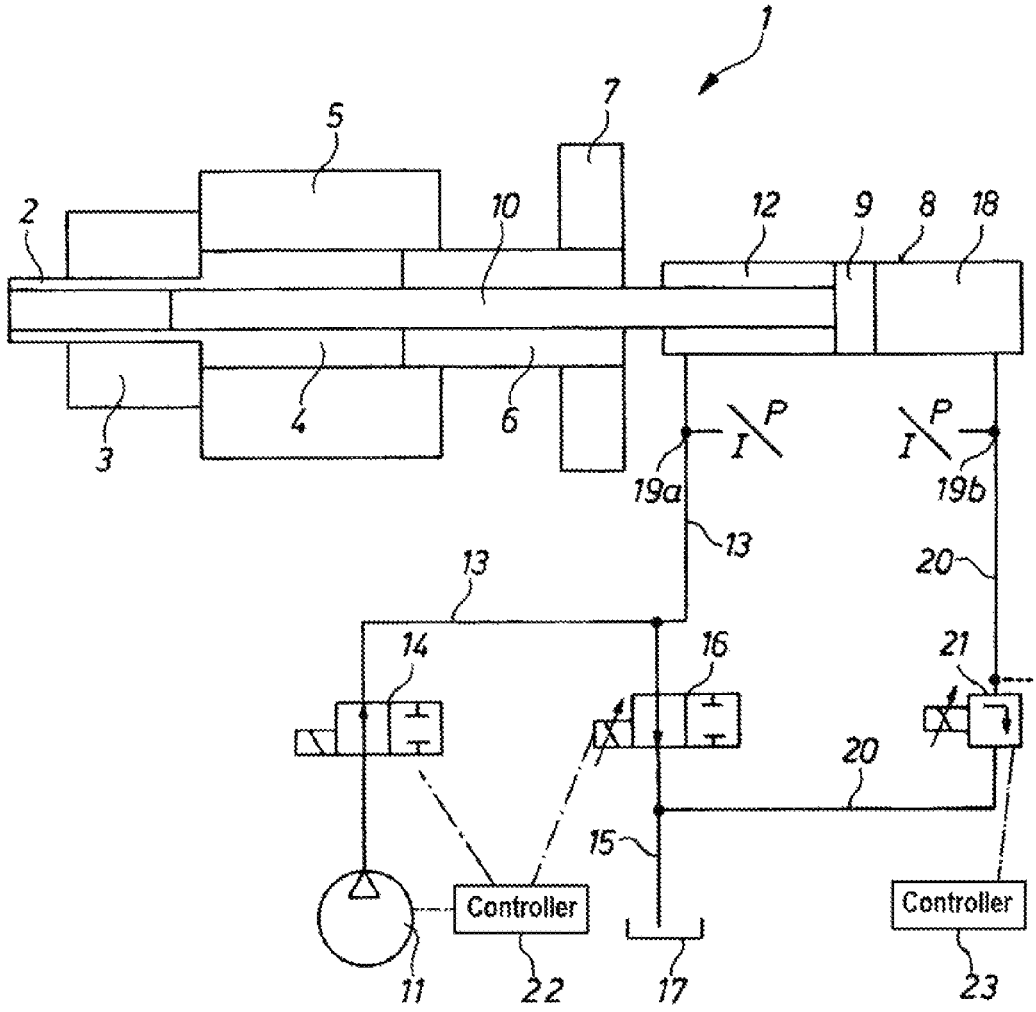
1
2
3
4
5
6
7
8
9
10
11
12
13
14
15
16
17
18
19a
19b
20
21
22
23
P
I
Controller
Controller

METHOD OF CONTROLLING MANDREL IN A TUBE-EXTRUDING PRESS

CROSS REFERENCE TO RELATED APPLICATIONS

This application is the U.S. national stage of PCT application PCT/DE2005/000049, filed 14 Jan. 2005, published 28 Jul. 2005 as WO 2005/068100, and claiming the priority of German patent application 102004002377.8 itself filed 15 Jan. 2004 and German patent application 102005001764.9 itself filed 13 Jan. 2005.

FIELD OF THE INVENTION

The invention relates to a method for controlling the position of a mandrel that is mounted in a hydraulic apparatus comprising a cylinder and a piston that form a piercing cylinder of an extrusion press for producing pipes that are extruded from billets that are loaded into a holder mounted upstream from the extrusion die and pierced by means of the mandrel.

BACKGROUND OF THE INVENTION

A metal extrusion press for the production of tubular workpieces and/or pipes has been disclosed in the German patent DE 1,227,858 (GB 929,056). There, a mandrel is mounted with the piercing cylinder on the main extrusion piston. The piston of the piercing cylinder is connected to a piercing cross-bar that is guided in the platen of the press in a sliding manner. Alternatively to such inside punching devices, it is known to provide the piercing cylinder outside the main extrusion piston or cylinder of the press.

Since the mandrel in general can have varying lengths, wear has to be taken into consideration, exact adjustment of the mandrel tip in the die opening is carried out by means of threaded spindles and spindle nuts with associated drives when extruding a pipe with a fixed mandrel. These are typically mounted in conjunction with mandrel stroke-limiting rods in the cylinder cross-piece or in the piercing cross-bar. Such an arrangement of a threaded spindle and spindle nut in the piercing cross-bar for limiting the stroke of the mandrel is disclosed for example in the patent mentioned above. The mandrel stroke-limiting rods here are fixed with one end in the cylinder cross-piece and carry stops on the other end facing the pressure plate. The piercing cross-bar is supported against these stops with a nut that limits the stroke and consequently the mandrel and that can be adjusted with the threaded spindle.

In order to be able to position the mandrel guided through the ram in the tool or in the die when extruding tubular workpieces and/or pipes, and in order to maintain this position throughout the extrusion process with high precision, during the practical operation of the extrusion press the mandrel is held in position during operation by means of a piercing cylinder. To allow this position of the mandrel to be maintained in the die, the cylinder has to move the mandrel back at exactly the same speed at which the ram performs the forward movement. Here however disturbances due to forming forces, friction and hydraulic compressibility come into play, which the control system has to compensate for dynamically.

Additionally, it is necessary to cover high speed ranges of 1:120 and greater. Finally, it is important to note that due to the application method considerable, variable tensile forces are applied to the mandrel, which can also reverse at the end of the extruding operation. In order to guarantee positioning, servo valves are used, via which the entire volume for the piercing cylinder is controlled. Since these servo valves can operate only a limited volume range, it is unavoidable that several servo valves in different nominal variables have to be provided parallel to each other for the speed ratio of 1:120.

OBJECT OF THE INVENTION

It is therefore the object of the invention to create a method of the type mentioned above that enables mandrel control that meets all necessary requirements in a simple manner and particularly without requiring servo valves.

SUMMARY OF THE INVENTION

This object is achieved according to the invention in that the piercing cylinder is directly driven by pumps that are adjusted to a defined pumping volume as a function of the extrusion speed and that a further pumping volume is added to the previously computed pump conveying volume, wherein for the purpose of controlling the position of the mandrel a control valve acting upon the front ring compartment of the piercing cylinder is connected to a tank. As a result of the direct drive, i.e. without an interposed control valve, so that no servo valve is mounted between the pump and piercing cylinder, but rather only conventional, cost-efficient and inexpensive-to-operate cartridge valves are used for the direction of motion, no pressure loss is produced for the pump volume flow. This way it is possible for the pump pressure to correspond to the operating pressure at the piercing cylinder. In addition, almost no energy losses occur, and the operating pressure at the pump is lower. The direct drive necessitates only a single, small control valve for the entire speed range, which valve additionally operates with very high precision and very quickly. This is associated with very large cost savings.

With the control principle according to the invention, the pumps are adjusted to a pumping volume as a function of the extrusion speed, which volume produces a substantially equal retraction speed of the piercing cylinder. This way, the mandrel assumes a substantially constant position in the die throughout the entire extrusion process. In order to enable the positioning and the correction of disturbances at the same time, according to the invention an additional pumping quantity is added to the pump conveying volume, over and above the computed pumping volume of the piercing cylinder. This additional pumping volume prevents the piercing cylinder from moving rearward out of the die position against the forward extrusion direction. The small control valve provided for control connected the front ring compartment of the piercing cylinder establishes the connection between the ring surface of the cylinder to the tank and controls the oil quantity to the tank required for positioning. If the oil volume to the tank is less than the value of the additional pumping volume, the mandrel is moved rearward out of the die; if the oil volume to the tank is higher, the mandrel is moved forward into the die. The control valve that maintains the position by means of a controller thus balances disturbances.

According to a preferred embodiment of the invention, it is proposed that the outlet pressure of the piercing cylinder is adjusted to a defined pressure. This way, control of the mandrel position can be achieved also with decreasing tensile forces in the mandrel or in the event of a reversal of the forces. To this end, advantageously a proportional pressure control valve is connected to the rear compartment or the piston side of the piercing cylinder. This way, stable control can be achieved even with reversing or decreasing forces on the mandrel.

If it is provided in an advantageous embodiment that the pressure levels in both compartments of the piercing cylinder are monitored, for example by means of pressure load cells connected to both the front ring compartment and the rear compartment of the piercing cylinder, in the event the value drops below a defined value the integration of a second controller and the monitoring of the pressure levels in both compartments allow the outlet pressure to be increased enough so that the defined pressure is present in the retraction side of the piercing cylinder. As a result, the hydraulic system is always in the tensioned state and allows a control regardless of the direction of the force.

BRIEF DESCRIPTION OF THE DRAWING

Further characteristics and details of the invention are disclosed in the drawing and the description provided hereinafter with reference to the schematic illustration of a control concept shown in the sole FIGURE.

DETAILED DESCRIPTION

The drawing diagrammatically shows a standard extrusion press 1 that is used to produce tubular workpieces and/or pipes 2, only the tool or die 3, the holder 5 that is mounted upstream and receives a billet 4 to be extruded, a ram 6 with a cross-piece 7 and a piercing cylinder 8 with a hydraulic system. The piercing cylinder 8 has a piston 9 that can be displaced forward and rearward, with a mandrel 10 that is carried by the piston 9, guided through the ram 6 and positioned with its tip or front end in the die 3.

The piercing cylinder 8 is driven directly by a pump 11. For this purpose, a front ring compartment 12 is connected via a hydraulic line 13 to the illustrated pump 11 that is associated with an intake valve 14 in the pumping direction. A tank line 15 branching off the hydraulic line 13 has a small, integrated control valve (NG10) 16 that is connected to a controller 22 and empties into a tank 17.

For controlling the position of the mandrel 10 with exact positioning of the front end in the tool 3, the pumping volume of the pump 11 that has been previously computed as a function of the extrusion speed is supplemented by an additional quantity of hydraulic fluid fed to the front ring compartment 12 of the piercing cylinder 8 in order to correct disturbances. Operation of the small control valve 16 by the controller 2 at the same time to move the mandrel 10 rearward out of the die 3 when the oil volume to the tank 17 is less than the value of the additional pumping volume. On the other hand, the mandrel 10 is moved further into the tool 3 when the oil volume to the tank 17 is greater than the value of the additional pumping volume. As a result, the mandrel 10 always assumes a substantially constant position in the tool 3 throughout the entire extrusion process.

The two compartments 12 and 18 of the piercing cylinder 8 are monitored in terms of pressure. For this purpose, respective pressure load cells 19*a* or 19*b* are associated with the front ring compartment 12 and the rear compartment 18. In an outlet line 20 leading from the rear compartment 18 of the piercing cylinder 8 to the tank line 15 and connected thereto via the small control valve 16, a proportional pressure control valve 21 is connected to another controller 23.

By monitoring the pressure levels in both compartments 12 and 18 and switching the pressure control valve 21 by means of the second controller 23, in the event that the defined pressure level is not reached the pressure in the rear compartment 18 can be increased enough so that the defined pressure is present in the front ring compartment 12 or the rear compartment of the piercing cylinder 8. The hydraulic system is therefore in a constant tensioned state and allows control regardless of the direction of the forces, so that a response to decreasing tensile forces on the mandrel 10 or a reversal of the forces is possible.

The invention claimed is:

1. A method for controlling the position of a mandrel that is mounted in a hydraulic extrusion apparatus comprising a cylinder and a piston that form a piercing cylinder, of an extrusion press for producing pipes that are extruded from billets that are loaded into a holder mounted upstream from the extrusion die and pierced by means of the mandrel, wherein the piercing cylinder is directly driven by pumps that are adjusted to a defined pumping volume as a function of the extrusion speed and that a further pumping volume is added to the previously computed pump conveying volume, a control valve acting upon the front ring compartment of the piercing cylinder being connected to a tank for the purpose of controlling the position of the mandrel.

2. The method according to claim 1, wherein the outlet pressure of the piercing cylinder is adjusted to a defined pressure.

3. The method according to claim 1 wherein the pressure levels in both sides of the piercing cylinder are monitored.

4. A method of operating a tube-extrusion press having a die having a cavity;

a holder for pressing a billet forward through the die;

a mandrel shiftable forward and backward and having a front end positionable in the die, whereby the billet pressed into the die around the mandrel is deformed into a tube;

a hydraulic cylinder having a piston connected to the mandrel and shiftable therewith, the cylinder defining a front ring compartment between the piston and the die and a rear compartment;

a pump for supplying pressure to the cylinder; and a tank connectable to the cylinder, the method comprising the steps of:

operating the pump such that it supplies a pressure in excess of what is needed to prevent forward movement of the mandrel into the die during extrusion; and bleeding pressure from the front compartment through a control valve to a tank to control the position of the mandrel relative to the die.

5. The method defined in claim 4, further comprising the step of maintaining the outlet pressure of the cylinder at a fixed pressure.

6. The method defined in claim 4, further comprising the steps of:

monitoring the pressures in the front and rear compartments and controlling the pump in accordance therewith.

* * * * *